US006151475A

United States Patent [19]

Uno

[11] Patent Number: 6,151,475

[45] Date of Patent: Nov. 21, 2000

[54] DEVELOPING APPARATUS FOR PREVENTING DETERIORATION OF TONER CHARGE QUANTITY AND FILMING OF TONER

[75] Inventor: Koji Uno, Kobe, Japan

[73] Assignee: Minolta Co., Ltd., Osaka, Japan

[21] Appl. No.: 09/347,935

[22] Filed: Jul. 6, 1999

[30] Foreign Application Priority Data

Jul. 6, 1998 [JP] Japan ..... 10-190179

[51] Int. Cl.[7] ..... G03G 15/08

[52] U.S. Cl. ..... 399/283; 347/55

[58] Field of Search ..... 399/281, 283, 399/284; 347/55

[56] References Cited

U.S. PATENT DOCUMENTS 4,378,158 3/1983 Kanbe ..... 399/281
4,814,796 3/1989 Schmidlin ..... 346/155
5,416,567 5/1995 Toyoshima et al. ..... 399/283
5,477,250 12/1995 Larson ..... 347/55
5,548,383 8/1996 Endoh ..... 399/284
5,666,625 9/1997 Komatsubara et al. ..... 399/281
5,689,782 11/1997 Murakami et al. ..... 399/281
5,708,942 1/1998 Sugiyama et al. ..... 399/281 X
5,748,212 5/1998 Takagi ..... 347/55

*Primary Examiner*—William J. Royer
*Attorney, Agent, or Firm*—Morrison & Foerster LLP

[57] ABSTRACT

A developing apparatus deterioration of toner charge quantity on double rollers and prevents filming of the toner. The developing apparatus includes a first roller for conveying a developer contained in a container, a blade for charging the developer on the first roller to a predetermined polarity and for restricting the conveyance quantity of the developer, and a second roller opposed to the first roller. The second roller receives the developer from the first roller to hold it on an outer surface thereof. The apparatus further includes a developer recovering device for recovering the developer from the second roller at a non-developing time.

9 Claims, 7 Drawing Sheets

DEVELOPING APPARATUS FOR PREVENTING DETERIORATION OF TONER CHARGE QUANTITY AND FILMING OF TONER

This application is based on application No. H10-190179 filed in Japan on Jul. 6, 1998, the content of which is hereby incorporated by reference.

1. Field of the Invention

The invention relates to a developing apparatus and a printing apparatus employing the same for use in copying machine, printer and so on.

2. Background of the Invention

U.S. Pat. No. 4,814,796 discloses a printing apparatus provided with a double roller type of developing apparatus. In the double roller type of developing apparatus, toner is charged to a predetermined polarity on a first roller, transferred to a second roller, and carried on the second roller to carry out the developing process.

However, in the double roller type developing apparatus, when the toner carried on the second roller is left as it is, the charge quantity of the toner is reduced, whereby an abnormal image is formed. Moreover, in the case that the second roller continuously rotates, the toner deteriorates by the friction and adheres to the second roller. Thus, a so-called "filming" occurs and then an abnormal image is formed.

SUMMARY OF THE INVENTION

Accordingly, the invention has been accomplished to solve the aforementioned disadvantages of the prior arts. An object of the invention is to provide a developing apparatus and a printing apparatus employing the same which is possible to form fine images by preventing the decrease of toner charge quantity and occurrence of filming.

In order to achieve the aforementioned object, according to the invention, there is provided a developing apparatus, comprising:

a container for containing a developer;

a first roller for conveying the developer contained in the container;

a blade for charging the developer on the first roller to a predetermined polarity and for restricting the conveyance quantity of the developer; and a second roller opposed to the first roller, the second roller receiving the developer from the first roller to hold it on an outer surface thereof, and conveying the developer to use it for developing, wherein the developing apparatus further comprises a developer recovering means for recovering the developer from the second roller at non-developing time so as to decrease toner charge quantity and to prevent filming.

In the developing apparatus according to the invention having the above construction, as the developer recovering means recovers the developer from the second roller at non-developing time, a decrease of toner charge quantity and an occurrence of filming do not occur, allowing good images to be formed.

In one embodiment of the developer recovering means, it may be arranged to apply a bias voltage to the first roller to recover the developer on the second roller to the first roller. In another embodiment of the developer recovering means, it may comprise a third roller disposed so as to oppose the second roller, and wherein a bias voltage is applied to the third roller to recover the developer on the second roller to the third roller. In this case, the third roller maybe provided with a magnet brush on an outer surface thereof. In addition to the developer recovering means, the developing apparatus may further comprise a developer recovering member which comes into contact with the second roller to physically recover the developer on the second roller.

Once the developer on the second roller is recovered, a large amount of developer is accumulated on opposing parts of the first roller and the blade. As a result, a developer layer subsequently formed on the first roller and the second roller would become uneven and the blade would vibrate causing a noise. Therefore, preferably, the bias voltage may be varied stepwise.

In another embodiment of the developer recovering means, there may be a developer recovering member which comes into contact with the second roller to physically recover the developer on the second roller.

In one embodiment of a printing apparatus according to the invention, the printing apparatus comprises:

a developing apparatus as described above, a backing electrode opposed to the second roller of the developing apparatus, the backing electrode generating an electric field which attracts the charged printing particles on the second roller to propel the same toward said backing electrode;

a printing head disposed between the second roller and the backing electrode, the printing head including a plurality of apertures through which the printing particles can propel and a plurality of electrodes disposed around the plurality of apertures, wherein the plurality of electrodes are applied with a voltage for allowing the printing particles to be propelled and a voltage for preventing the printing particles to be propelled in response to an image signal, whereby the printing particles are directly deposited on a print medium to print the image.

In another embodiment of the printing apparatus according to the invention, the printing apparatus comprises:

a developing apparatus as described above, an electrostatic latent image carrying member opposed to the second roller of the developing apparatus;

a transfer member opposed to the electrostatic latent image carrying member, wherein an electrostatic latent image is formed on the electrostatic latent image carrying member based on an image signal, the electrostatic latent image is developed by the developer held on the second roller of the developing apparatus to form a developer image, the developer image is transferred to a print medium by the transfer member.

BRIEF DESCRIPTION OF THE DRAWINGS

Further objects and advantages of the invention will be become clear from the following description taken in conjunction with the preferred embodiments thereof with reference to the accompanying drawings, in which.

DETAILED DESCRIPTION OF THE PREFERRED EMBODIMENTS

First Embodiment

Figure 1:
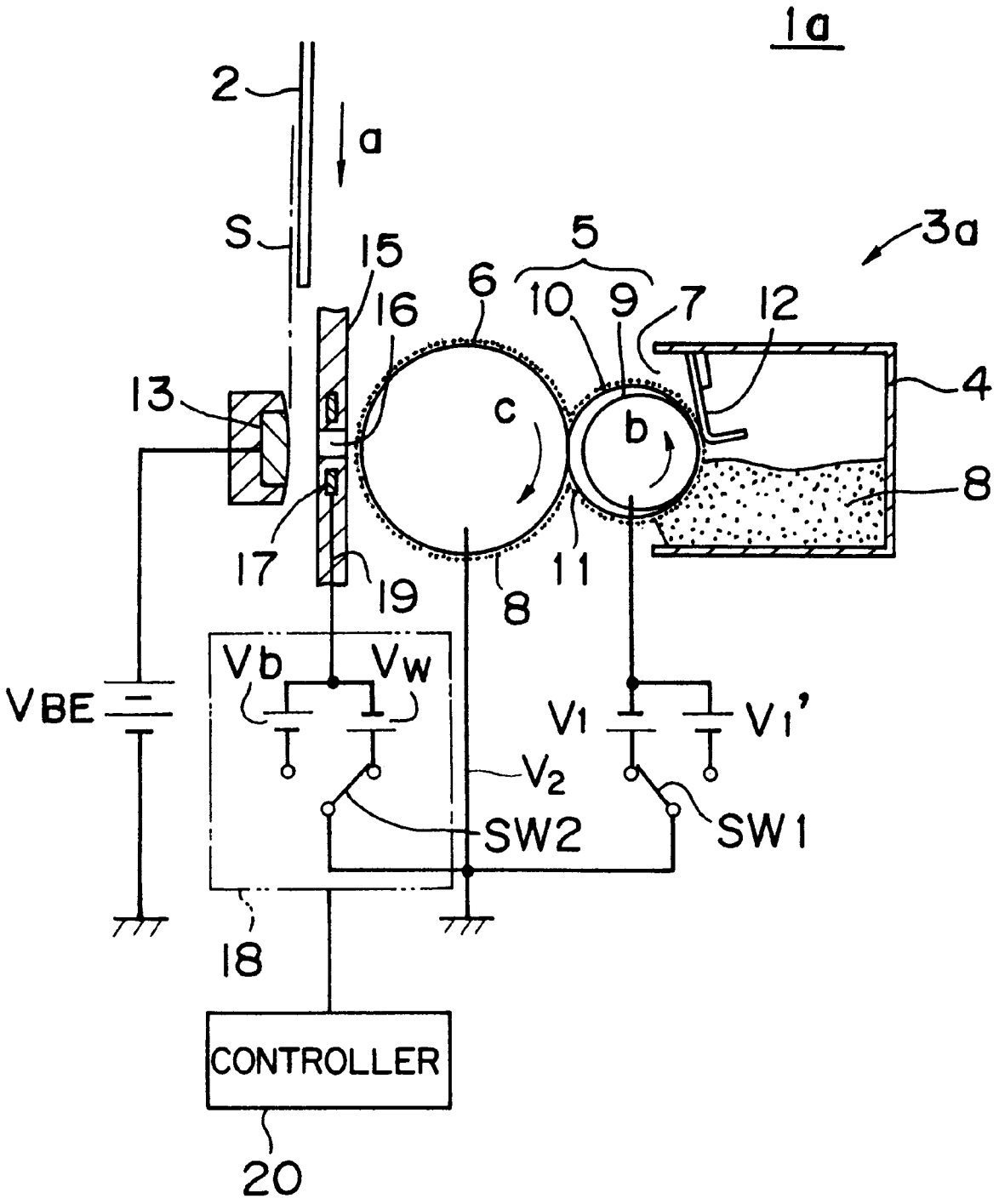
FIG. 1 is a schematic cross-sectional view of a printing apparatus with a developing apparatus according to a first embodiment of the invention.

With reference to FIG. 1, there is shown a printing apparatus 1*a* with a developing apparatus according to a first embodiment of the invention. The printing apparatus 1*a* is arranged to print an image on a sheet 2 conveyed along sheet passage S in a direction indicated by an arrow "a" from a sheet feed roller (not shown). The printing apparatus 1*a* is provided with a developing apparatus generally indicated by reference numeral 13*a*. The developing apparatus 3*a* comprises a container 4, a first roller 5 and a second roller 6. The container 4 has an opening 7 and accommodates a developer, i.e., toner particles (hereinafter simply referred to as toner) 8 which comprise one component and are capable of being charged with negative polarity. The first roller 5 is disposed in the opening 7 of the container 4 and comprises a drive roller 9 rotatably supported in a direction of arrow "b" and a developing sleeve 10 inserted outside the drive roller 9.

The developing sleeve 10 is made of a metal material such as nickel or resin material such as carbon-contained nylon. The inner diameter of the developing sleeve 10 is larger than the outer diameter of the drive roller 9. The developing sleeve 10 is formed with a slack 11 by coming into contact with the drive roller 9. The developing sleeve 10 is capable of rotating along with the drive roller 9 in a direction of arrow "b". A blade 12, preferably made of a metal material such as stainless steel, extends from the wall of the container 4 and comes into contact with the outer surface of the developing sleeve 10. To the developing sleeve 10 is selectively applied either a voltage V1 (−100 volts) having the same polarity as the toner 8 or a voltage V1' (+50 volts) having a reverse polarity to the toner 8 by a switch SW1. The second roller 6 is disposed so that it comes into contact with the slack 11 of the developing sleeve 10 of the first roller 5 and is opposed to a backing electrode 13 as described hereinafter. The second roller 6 is rotatably supported in a direction of arrow "c". The second roller 6 is made of a conductive material and is electrically connected to the earth (V2=0 volt).

The printing apparatus la is also provided with a backing electrode generally indicated by reference numeral 13. The backing electrode 13 is disposed at the opposite side to the developing apparatus 3*a* with respect to the sheet passage S so that the backing electrode 13 is opposed to the second roller 6. To the backing electrode 13 is applied a voltage $V_{BE}$ of predetermined polarity (positive polarity in this embodiment), for example, +1200 volts. Thus, between the backing electrode 13 and the second roller 6 is formed an electric field so that the negatively charged toner 8 on the second roller 6 is electrically attracted to the backing electrode 13.

Between the developing apparatus 3*a* and the backing electrode 13 and at the opposite side to the backing electrode 13 with respect to the sheet passage S, the printing apparatus 1*a* is also provided with a printing head generally indicated by reference numeral 15. At a region where the second roller 6 and the backing electrode 13 are opposed to each other, the printing head 15 is formed with a plurality of apertures 16 having a diameter of about 25 to 200 micrometers which is substantially larger than an average diameter (about several micrometers to a dozen micrometers) of the toner 8. The apertures 16 are disposed in a direction perpendicular to the sheet passage S.

The printing head 15 further includes therein doughnut-like control electrodes 17 which surround the respective apertures 16. The control electrodes 17 are electrically connected to a driver 18 through a printed wire 19 so that the driver 18 can transmit image signals to the control electrodes 17, respectively. The driver 18 is in turn electrically connected to a controller 20 which feeds out data of image.

The image signals to be transmitted to the control electrodes 17 consist of a voltage Vw applied to the control electrodes 17 around the apertures 16 corresponding to non-print portions of the sheet 2 and a voltage Vb applied to the control electrodes 17 around the apertures 16 corresponding to print portions of the sheet 2. The voltage Vw and Vb are switched by a switch SW2 in response to the image data from the controller 20. In this embodiment, for example, the voltage Vw for the non-print portion is about −50 volts, and the voltage Vb for the print portion is about +300 volts.

Operation of the printing apparatus 1*a* having the above features will now be described.

In the printing apparatus 1*a*, a main motor (not shown) is driven to rotate the drive roller 9 of the first roller 5, which is applied with a voltage V1 (−100 volts) having the same polarity as the toner 8, in the direction of arrow "b", whereby the developing sleeve 10 rotates in the same direction. The toner 8 in the container 4 is moved on the developing sleeve 10 and then transported to a contact region with the blade 12 where the toner 8 is provided with triboelectric negative charge by the frictional contact with the blade 12. Thereby, the toner 8 is carried on the developing sleeve 10. The toner 8 carried on the developing sleeve 10 is delivered to the second roller 6 at an opposite portion to the second roller 6 connected to earth (ground).

In the printing head 15, the voltage Vw of about −50 volts is applied to the control electrodes 17 at the non-printing time. Therefore, the negatively charged toner 8 on the second roller 6 electrically repels against the control electrodes 17 and therefore stays on the second roller 6 without propelling toward the apertures 16.

The controller 20 outputs the image data corresponding to an image to be reproduced to the driver 18. In response to the image data, the driver 18 applies the voltage Vw of −50 volts to the non-print portion and the voltage Vb of +300 volts to the print portion by switching the switch SW2.

As a result, at the non-print portion, the control electrodes 17 have the same polarity as the toner 8 on the second roller 6 and have an electric potential existing on the minus side with respect to the second roller 6. Thus, the toner 8 on the second roller 6 is not propelled to the control electrodes 17, whereby no image is formed on the sheet 2. On the other hand, at the print portion, the control electrodes 17 are applied with the voltage Vb of +300 volts. Thus, the toner 8 on the second roller 6 which is opposed to the control electrodes 17 is electrically attracted by the control electrodes 17 and the backing electrode 13 to propel through the apertures 16, whereby the converged mass of the toner 2 is deposited on the sheet 8 to form an image on the sheet 2.

In the printing apparatus 1*a*, when the toner 8 on the second roller 6 of the developing apparatus 3*a* is left as it is at the time of non-print, toner charge quantity is decreased and filming occurs, whereby an abnormal image is formed. So, at the time of non-print, for example, at the time of power ON or OFF, between pages of the print medium, pre-printing, or post-printing, the toner 8 on the second roller 6 of the developing apparatus 3*a* is recovered. By switching the switch SW1, the voltage V1' (+50 volts) having reverse polarity to the toner 8 is applied to the first roller 5. When rotating the first roller 5 and the second roller 6 is rotated in the same manner as at the time of print, the toner 8 carried on the second roller 6 is recovered to the first roller 5 at the region opposite to the first roller 5 to which the voltage having reverse polarity to the toner 8 is applied. Thus, the toner 8 on the second roller 6 is not left as it is, preventing a decrease of toner charge quantity and an occurrence of filming.

Figure 2:
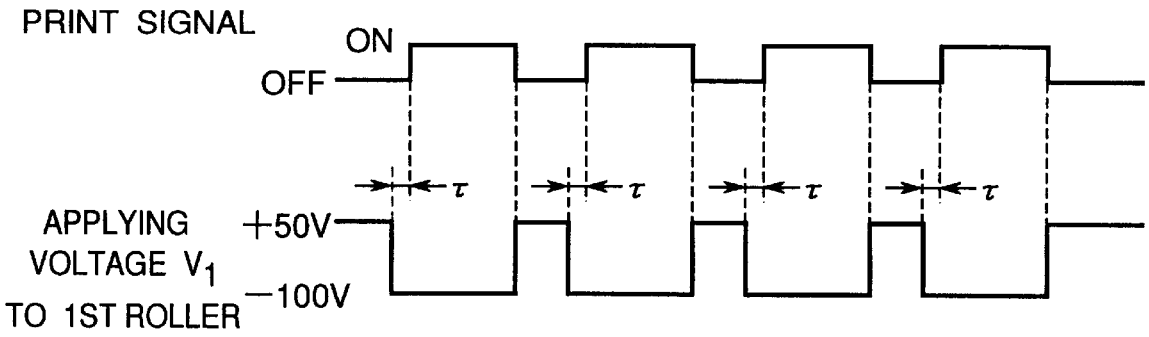
FIG. 2 is a time chart showing an example of toner recovering timing.

The timing of toner recovering will be explained, for example, in the case of continuous printing in which the print is conducted at a constant time interval as shown in FIG. 2. Each time when the print signal is OFF, the applying voltage V1 to the first roller 5 is switched to the voltage of reverse polarity to the toner 8, i.e., +50 volts to recover the toner 8 on the second roller 6. Thus, inserting the toner recovering process between images during the continuous printing enables the printing apparatus to print without forming an abnormal image. In addition, at a constant time $\tau$ before the print signal turns ON, the applying voltage V1 to the first roller 5 is switched to the voltage having the same polarity as the toner 8, i.e., −100 volts to feed the toner 8 on the second roller 6 for the next print. The constant time $\tau$ is the time it takes the toner 8 to transfer to the opposed region between the second roller 6 and the printing head 15 after the toner 8 starts to move to the second roller 6 from the first roller 5. Thus, feeding the toner on the second roller 6 to form the toner layer thereon before commencement the each print process enables the elimination of the delay of the printing time.

Figure 3:
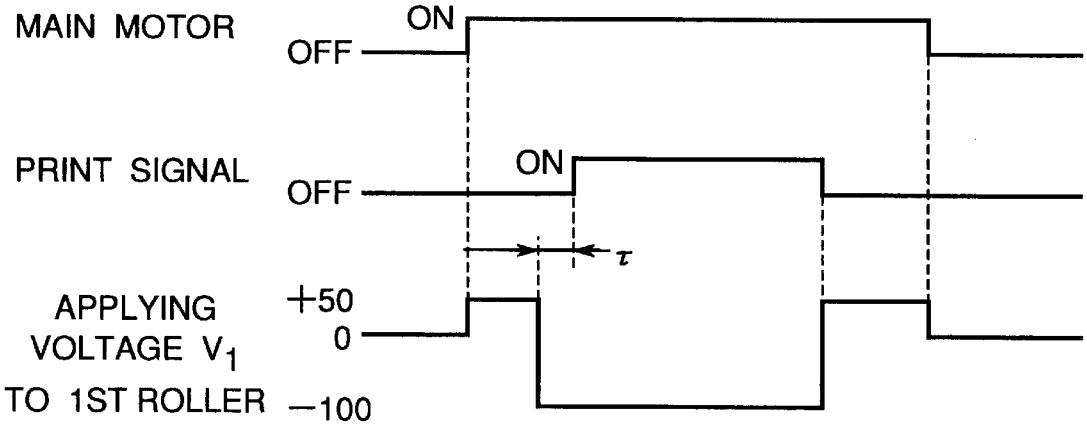
FIG. 3 is a time chart showing an another example of toner recovering timing.

As an another example of toner-recovering timing, a pre-job start sequence is preferably conducted as shown in FIG. 3. When the previous printing operation is compulsorily discontinued due to paper jam treatment or the like, the toner 8 may remain on the second roller 6. In such case, the pre-job start sequence provides for recovering the toner 8 on the second roller 6 by switching the applying voltage V1 to the first roller 5 to +50 volts of reverse polarity to the toner 8 at the same time as the main motor becomes ON. In the pre-job star sequence, it is also preferable as described in the example of FIG. 2 that at a time $\tau$ before the print signal becomes ON to start the job (printing operation), the applying voltage V1 to the first roller 5 is switched to −100 volts of the same polarity as the toner 8 to feed the toner 8 on the second roller 6 for the next print. As the post-job sequence ends, it is also preferable that at the same time as the print signal becomes OFF to terminate the print job, and to switch the applying voltage V1 on the first roller 5 to +50 volts of reverse polarity to the toner 8 to recover the toner 8 on the second roller 6.

Second Embodiment

Hereinafter, another embodiment of the invention will be explained. In this embodiment, only different parts from the aforementioned first embodiment will be described and the same reference numerals will be affixed to other substantially same parts as the first embodiment to omit the explanation thereof.

Figure 4:
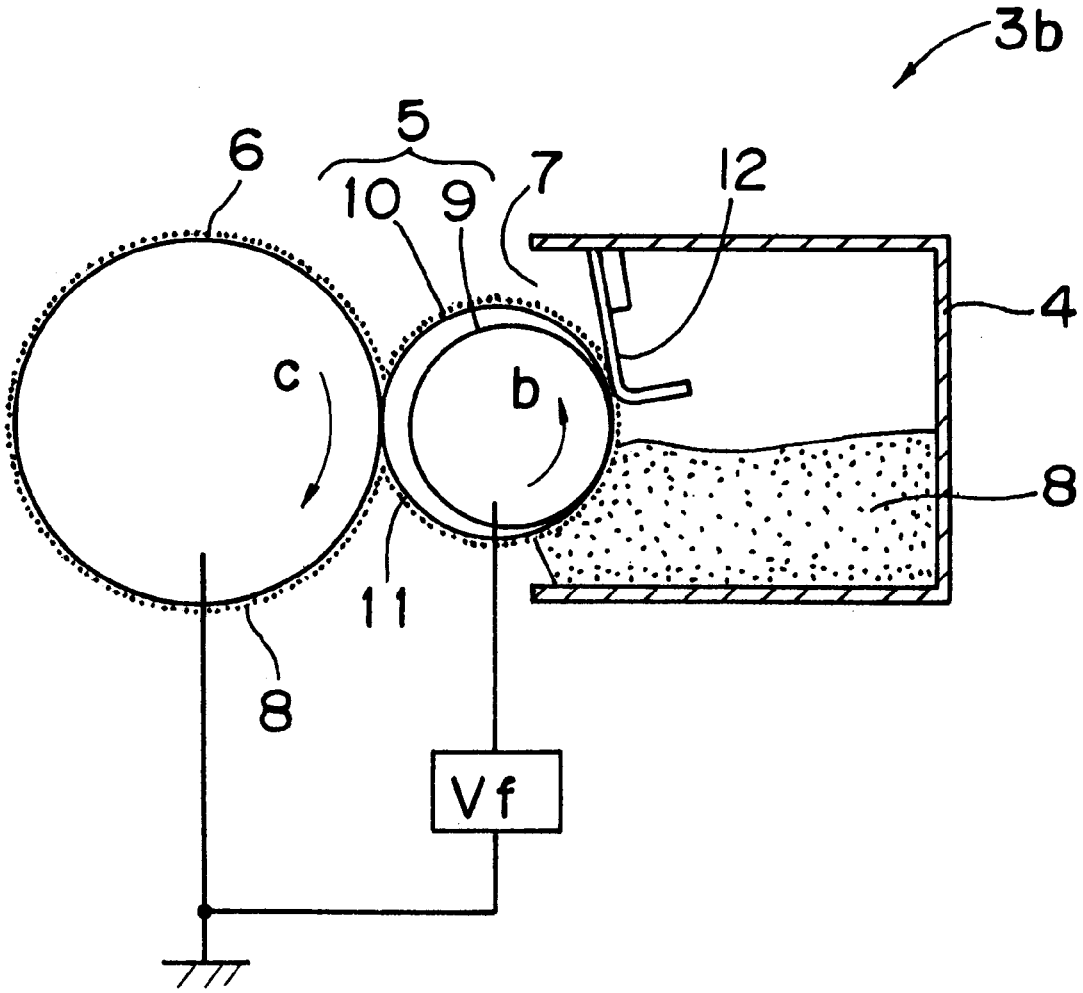
FIG. 4 is a schematic cross-sectional view of a developing apparatus according to a second embodiment of the invention.
Figure 5:
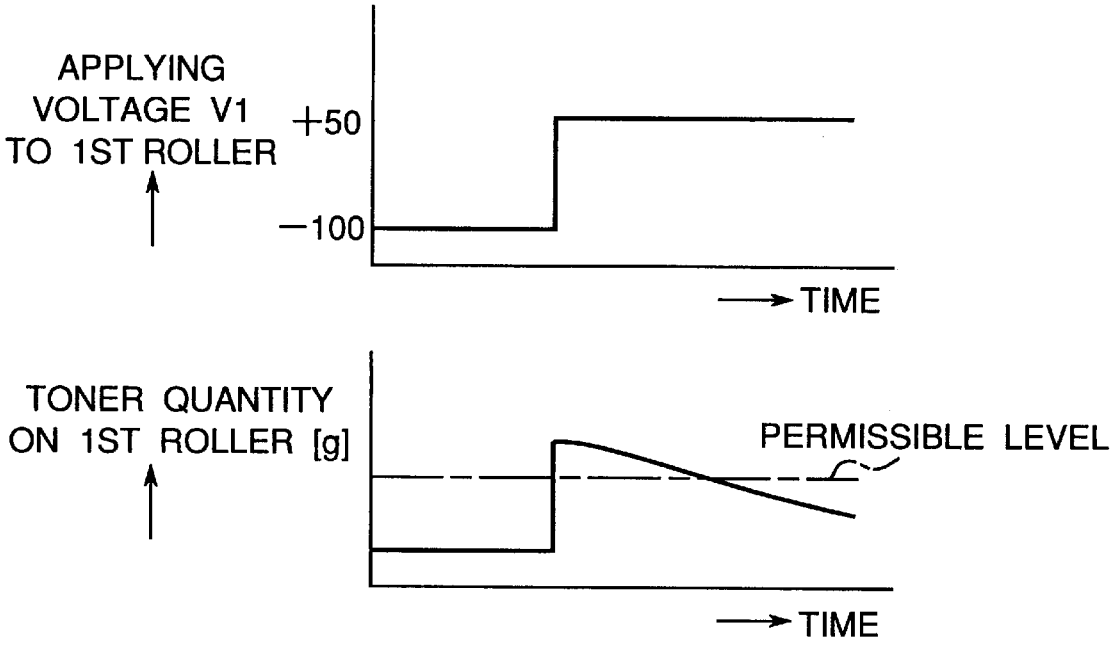
FIG. 5 is a graph showing a variation of toner quantity on the first roller when applying a toner recovering voltage to the first roller with a leap.
Figure 6:
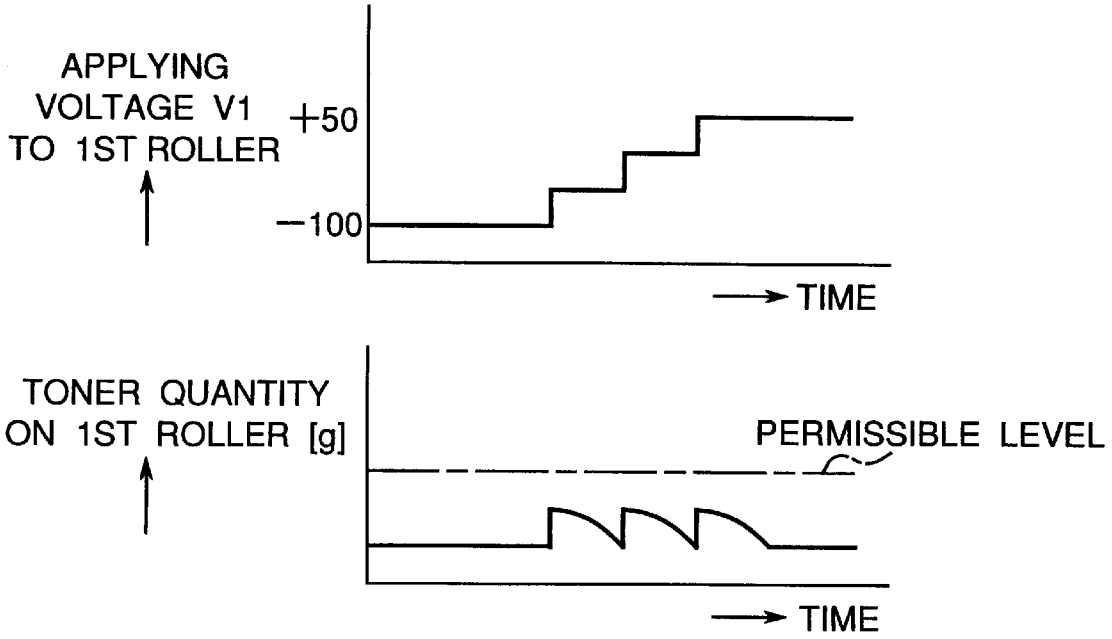
FIG. 6 is a graph showing a variation of toner quantity on the first roller when applying a toner recovering voltage to the first roller stepwise.

FIG. 4 shows a developing apparatus 3*b* according to a second embodiment of the invention. In the developing apparatus 3*b*, a variable voltage Vf can be applied to the first roller 5 step wise in the following situation. When the applying voltage Vf to the first roller 5 is changed to +50 volts from −100 volts with a leap as shown in FIG. 5 to recover the toner 8 on the second roller 6, a large quantity of toner 8 is recovered to the first roller 5 at a time and accumulated between the first roller 5 and the blade 12, whereby the toner quantity on the first roller 5 is beyond a permissible level as shown in one-dot chain line. This causes such problems at the next print that the image would become uneven and the blade 12 would vibrate so as to cause a noise. Thus, at the time when the applied voltage Vf to the first roller 5 is changed to +50 volts from −100 volts, it is conducted stepwise as shown in FIG. 6, allowing the toner quantity on the first roller 5 to be suppressed below the permissible level. As a result, a good image could be formed at the next print.

Third Embodiment

Figure 7:
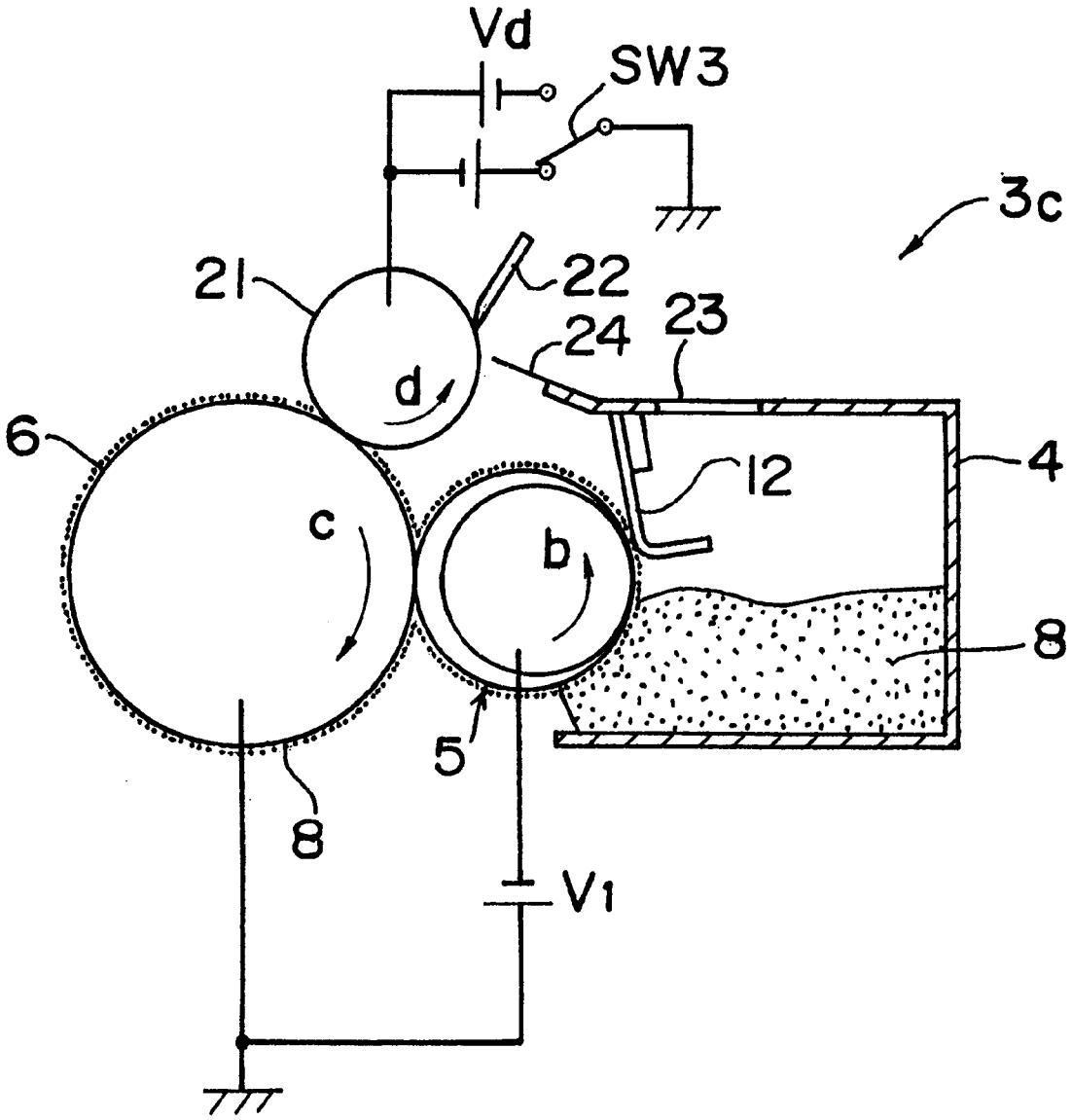
FIG. 7 is a schematic cross-sectional view of a developing apparatus according to a third embodiment of the invention.

FIG. 7 shows a developing apparatus 3*c* according to a third embodiment of the invention. In the developing apparatus 3*c*, a third roller 21 for recovering the toner 8 on the second roller 6 is provided. The third roller 21 is disposed so as to rotate in a direction of arrow "d" with respect to the second roller 6. To the third roller 21 is selectively applied either a recovery voltage Vd (+50 volts) having a reverse polarity to the toner 8 or a recovery preventing voltage (−50 volts) by a switch SW3. The third roller 21 is provided with a scraper 22 for scraping the toner 8 on the third roller 21 and a guide 24 for guiding the toner 8 scraped by the scraper 22 to the developing container 4 through a hole 23 formed on the container 4.

In the developing apparatus 3*c*, at the printing time, a voltage of −50 volts is applied to the third roller 21 so that the toner 8 carried on the second roller 6 is not moved to the third roller 21. When the toner 8 on the second roller 6 is recovered at the non-printing time, the voltage Vd having a reverse polarity to the toner 8 is applied to the third roller 21. As a result, the toner 8 on the second roller 6 is moved to the third roller 21 at the region opposed to the third roller 21 and transferred in the direction of arrow "d" to be scraped by the scraper 22. The scraped toner 8 is guided by the guide 24 and recovered in the container 4 through the hole 23 of the container 4.

Fourth Embodiment

Figure 8:
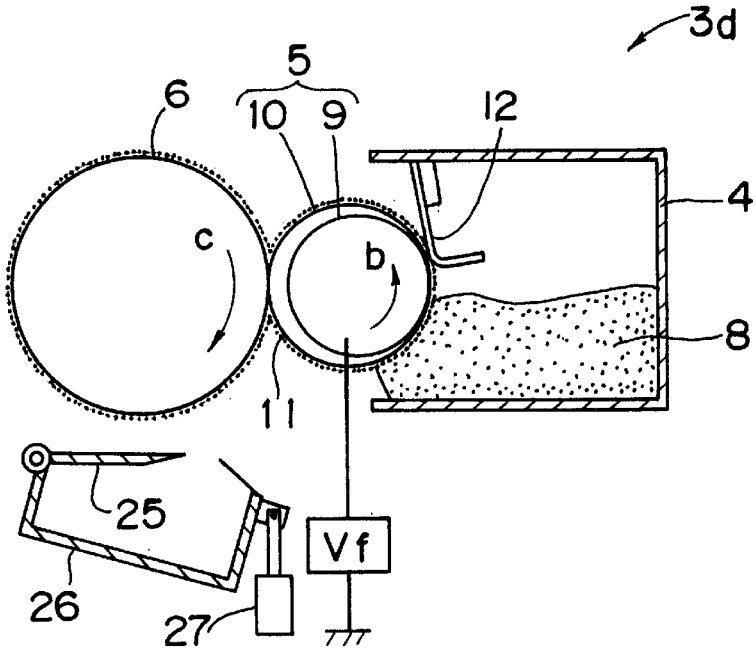
FIG. 8 is a schematic cross-sectional view of a developing apparatus according to a fourth embodiment of the invention.
Figure 9:
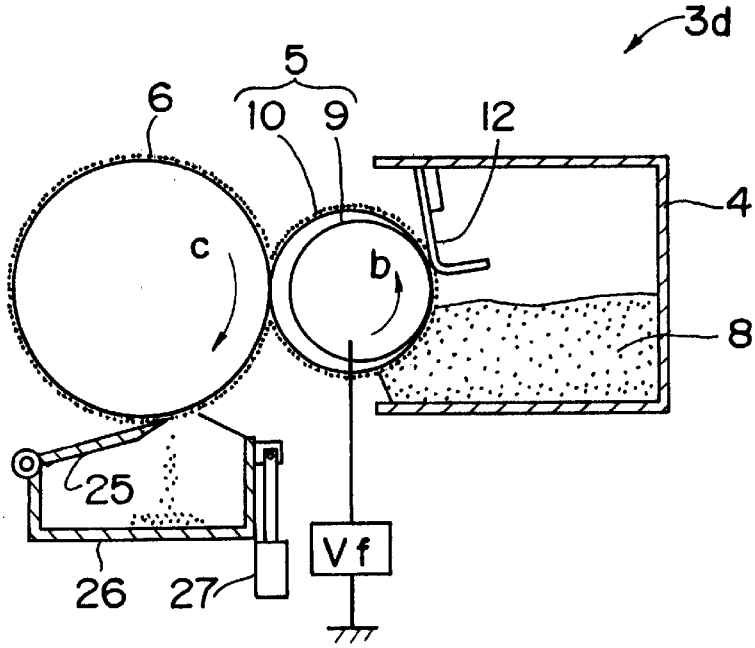
FIG. 9 is a schematic cross-sectional view of the developing apparatus of FIG. 8 at the time of toner recovery.

FIGS. 8 and 9 show a developing apparatus 3*d* according to a fourth embodiment of the invention. In the developing apparatus 3*d*, a blade 25 for recovering the toner 8 adhering to the second roller 6 is provided. The blade 25 is mounted on an opening edge of a recovery container 26 and extended toward the second roller 6. The blade 25 is movable by means of a solenoid 27 between a retreat position where the free end of the blade 25 is apart from the second roller 6 and a recovery position where the free end of the blade 25 comes into contact with the second roller 6.

In the developing apparatus 3*d*, at the printing time, the blade 25 is positioned at the retreat position so that the toner 8 carried on the second roller 6 is not scraped. When the toner 8 on the second roller 6 is recovered at the non-printing time, the applied voltage to the first roller 5 is changed to +50 volts from −100 volts stepwise in the same manner as in the second embodiment so that the majority of the toner 8 on the second roller 6 is recovered. However, according to the recovery by such electric field, it may be quite rarely impossible to recover the toner 8 adhered to the second roller 6. If the toner 8 adhered to the second roller 6 remains as it is, it would be the core of toner fixation that affects the image printing. Thus, after the recovery of the toner 8 by the electric field, the blade 25 is moved to the recovery position as shown in FIG. 9 so that the core of the toner 8 adhered to the second roller 6 is removed and recovered into the recovery container 26.

In the fourth embodiment, it is preferable to provide a conveying means such as a chute or a conveyor for conveying the toner 8 recovered in the recovery container 26 to the developing container 4 in order to recycle the toner 8. It is also preferable to recover all of the toner 8 on the second roller 6 by the blade 25 without applying the toner recovery voltage to the first roller 5. It is also preferable to provide a brush or, a sponge such as mortoprain instead of the blade 25.

Fifth Embodiment

Figure 10:
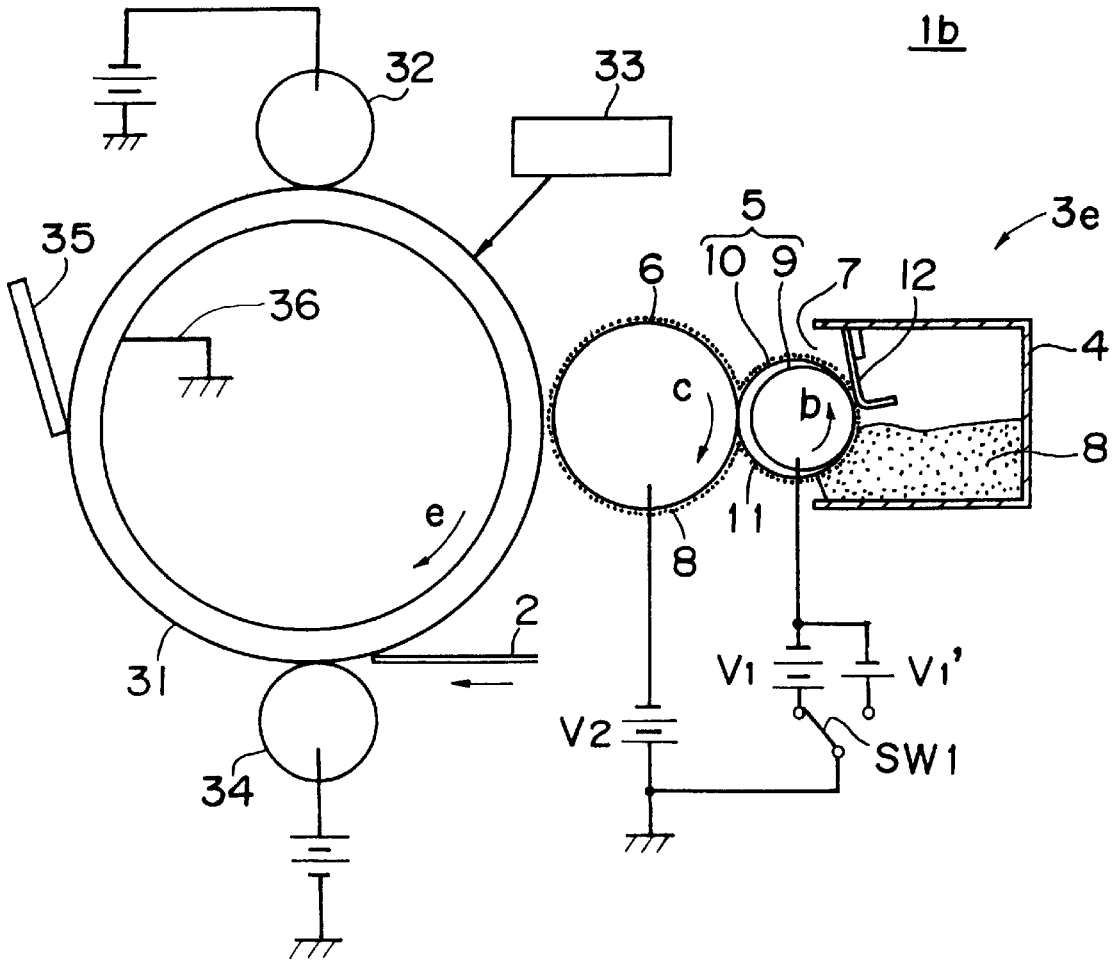
FIG. 10 is a schematic cross-sectional view of a printing apparatus with a developing apparatus according to a fifth embodiment of the invention.

FIG. 10 shows a printing apparatus 1*b* with a developing apparatus 3*e* according to a fifth embodiment of the invention. The developing apparatus 3*e* has almost the same construction as the developing apparatus 3*a* according to the first embodiment as shown in FIG. 1 except for the following. To the first roller 5 can be selectively applied either a toner layer forming bias voltage V1 (for example, −400 volts) or a toner layer recovering bias voltage V1' (for example, −200 volts) by a switch SW1. To the second roller 6 is applied a developing bias voltage V2 (for example, −300 volts).

The developing apparatus 3*e* is disposed so that the second roller 6 is opposed to a photosensitive drum 31. The photosensitive drum 31 is rotatable in a direction of arrow "e" and connected to earth 36. Around the photosensitive drum 31, an electrostatic charger 32 is disposed at the upstream side of the developing apparatus 3*e* with respect to the rotational direction. Downstream of the electrostatic charger 32 is disposed a laser device 33. Moreover, downstream of the developing apparatus 3*e* with respect to the rotational direction is disposed a transfer member 34 to which a voltage of +1500 volts is applied. In addition, downstream of the transfer member 34 is disposed a cleaning member 35.

In the printing apparatus 1*b*, at the printing time, a toner layer forming bias voltage V1 is applied to the first roller 5 so that the toner 8 in the container 4 is moved to the first roller 5 and then second roller 6 so that the toner layer is carried on the second roller 6. On the other hand, the surface of the photosensitive drum 31 is charged by the electrostatic charger 32 to a a voltage of −600 volts and then exposed to laser beam by the laser device 33 in response to an image signal. The minus electric charge on the exposed portion is erased to about zero volt so that an electrostatic latent image is formed. At the region opposed to the developing apparatus 3*e*, the toner 8 on the second roller 6 applied with a voltage of −300 volts is moved to the portion formed with the electrostatic latent image so that the electrostatic latent image is developed to become a toner image. The toner image is moved to the region opposed to the transfer member 34, where it is transferred to the sheet 2 which is conveyed to the region. The toner 8 remaining on the photosensitive drum 31 is cleaned by the cleaning member 35.

At the non-printing time, the toner 8 on the second roller 6 is recovered in the same manner as in the aforementioned embodiment to prevent the fixation or filming thereof. Namely, the toner layer recovering bias voltage V1' is applied to the first roller 5 to recover the toner 8 on the second roller 6 to the first roller 5.

Although the aforementioned embodiments were explained as to a monochrome type of printing apparatus having a single developing apparatus, the invention is also applicable to a tandem type of color direct printing apparatus in which a plurality of printing apparatus are disposed in a sheet moving direction.

In the aforementioned embodiments, although the printing apparatus is a type of one component system using only the toner 8, a type of two components system using both a toner and a carrier may also be applicable.

Although the invention has been fully described by way of the examples with reference to the accompanying drawings, it is to be noted that various changes and modifications will be apparent to those skilled in the art. Therefore, unless such changes and modifications otherwise depart from the spirit and scope of the invention, they should be construed as being included therein.

What is claimed is:

1. A developing apparatus, comprising:

a container for containing a developer;

a first roller for conveying the developer contained in the container;

a blade for charging the developer on the first roller to a predetermined polarity and for restricting the conveyance quantity of the developer; and a second roller opposed to the first roller, the second roller receiving the developer from the first roller to hold it on an outer surface thereof, and conveying the developer to use it for developing, wherein the developing apparatus further comprises developer recovering means for recovering the developer from the second roller at a non-developing time so as to prevent deterioration of a toner charge quantity and filming of the toner.

2. A developing apparatus as claimed in claim 1, wherein the developer recovering means is arranged to apply a bias voltage to the first roller to recover the developer on the second roller to the first roller.

3. A developing apparatus as claimed in claim 2, further comprising a developer recovering member which comes into contact with the second roller to physically recover the developer on the second roller.

4. A developing apparatus as claimed in claim 2, wherein the bias voltage is varied stepwise.

5. A developing apparatus as claimed in claim 1, wherein the developer recovering means comprises a third roller disposed so as to oppose to the second roller, and wherein a bias voltage is applied to the third roller to recover the developer on the second roller to the third roller.

6. A developing apparatus as claimed in claim 5, wherein the third roller is provided with a magnet brush on an outer surface thereof.

7. A developing apparatus as claimed in claim 1, wherein the developer recovering means is a developer recovering member which comes into contact with the second roller to physically recover the developer on the second roller.

8. A printing apparatus, comprising:

a developing apparatus comprising a container for containing a developer; a first roller for conveying the developer contained in the container; a blade for charging the developer on the first roller to a predetermined polarity and for restricting the conveyance quantity of the developer; and a second roller opposed to the first roller, the second roller receiving the developer from the first roller to hold it on an outer surface thereof, and conveying the developer to use it for developing, wherein the developing apparatus further comprises developer recovering means for recovering the developer from the second roller at a non-developing time so as to prevent deterioration of a toner charge quantity and filming of the toner;

a backing electrode opposed to the second roller of the developing apparatus, the backing electrode generating an electric field that attracts charged printing particles on the second roller to propel the same toward said backing electrode; and a printing head disposed between the second roller and the backing electrode, the printing head including a plurality of apertures through which the printing particles can propel and a plurality of electrodes disposed around the plurality of apertures, wherein the plurality of electrodes are applied with a first voltage which allows the printing particles to be propelled and a second voltage which prevents the printing particles to be propelled in response to an image signal, whereby the printing particles are directly deposited on a print medium to print the image.

9. A printing apparatus, comprising:

a developing apparatus comprising a container for containing a developer; a first roller for conveying the developer contained in the container; a blade for charging the developer on the first roller to a predetermined polarity and for restricting the conveyance quantity of the developer; and a second roller opposed to the first roller, the second roller receiving the developer from the first roller to hold it on an outer surface thereof, and conveying the developer to use it for developing, wherein the developing apparatus her comprises developer recovering means for recovering the developer from the second roller at a non-developing time so as to prevent deterioration of a toner charge quantity and filming of the toner;

an electrostatic latent image carrying member opposed to the second roller of the developing apparatus; and a transfer member opposed to the electrostatic latent image carrying member, wherein an electrostatic latent image is formed on the electrostatic latent image carrying member based on an image signal, the electrostatic latent image is developed by the developer held on the second roller of the developing apparatus to form a developer image, the developer image is transferred to a print medium by the transfer member.

* * * * *

UNITED STATES PATENT AND TRADEMARK OFFICE

CERTIFICATE OF CORRECTION

PATENT NO. : 6,151,475
DATED : November 21, 2000
INVENTOR(S) : Koji Uno

It is certified that error appears in the above-identified patent and that said Letters Patent is hereby corrected as shown below:

Item [73] Assignee:
Add -- Array Printers AB, Vastra Frolunda, Sweden. --

Signed and Sealed this

Fourteenth Day of August, 2001

*Attest:*

Nicholas P. Godici

*Attesting Officer*

NICHOLAS P. GODICI
*Acting Director of the United States Patent and Trademark Office*